United States Patent [19]

Harrison et al.

[11] 4,425,108

[45] Jan. 10, 1984

[54] METHOD OF MAKING POLYETHYLENE SHIPPING SACK WITH FLEXOGRAPHICALLY APPLIED BARRIER COATING

[75] Inventors: Ray E. Harrison, Brampton; Charles R. Murray, Toronto, both of Canada

[73] Assignee: C-I-L Inc., North York, Canada

[21] Appl. No.: 251,755

[22] Filed: Apr. 7, 1981

[30] Foreign Application Priority Data

Jan. 12, 1981 [CA] Canada ..... 368289

[51] Int. Cl.[3] ..... B31B 49/04

[52] U.S. Cl. ..... 493/220; 493/326; 493/330

[58] Field of Search ..... 493/187, 188, 220, 328, 493/330, 326; 428/476.1, 475.8

[56] References Cited

U.S. PATENT DOCUMENTS

| | | | |
|---|---|---|---|
| 3,164,068 | 1/1965 | Linacre et al. | 493/188 |
| 3,286,005 | 11/1966 | Cook | 493/187 X |
| 3,503,859 | 3/1970 | Goncarovs et al. | 493/326 X |
| 3,537,225 | 11/1970 | Fields | 493/188 X |
| 4,284,672 | 8/1981 | Stillman | 428/476.1 X |
| 4,284,674 | 8/1981 | Sheptak | 428/476.1 X |
| 4,370,388 | 1/1983 | Mito et al. | 428/476.1 X |

OTHER PUBLICATIONS

"II. Methods of Printing Polyethlene", from *Flexographic Printing*, F.E. Boughton, 1958.

*Primary Examiner*—James F. Coan
*Attorney, Agent, or Firm*—Bernard F. Roussin

[57] ABSTRACT

A polyethylene shipping bag having an internal nylon barrier coating which permits packaging of materials which normally migrate through polyethylene. The coating is flexographically applied from a nylon solution in a lower aliphatic alcohol with up to 15% water to a polyethylene film which has been previously treated to make it receptive to printing ink. The bag may be single ply or double ply and may have a filling valve.

8 Claims, 2 Drawing Figures

Fig. 1
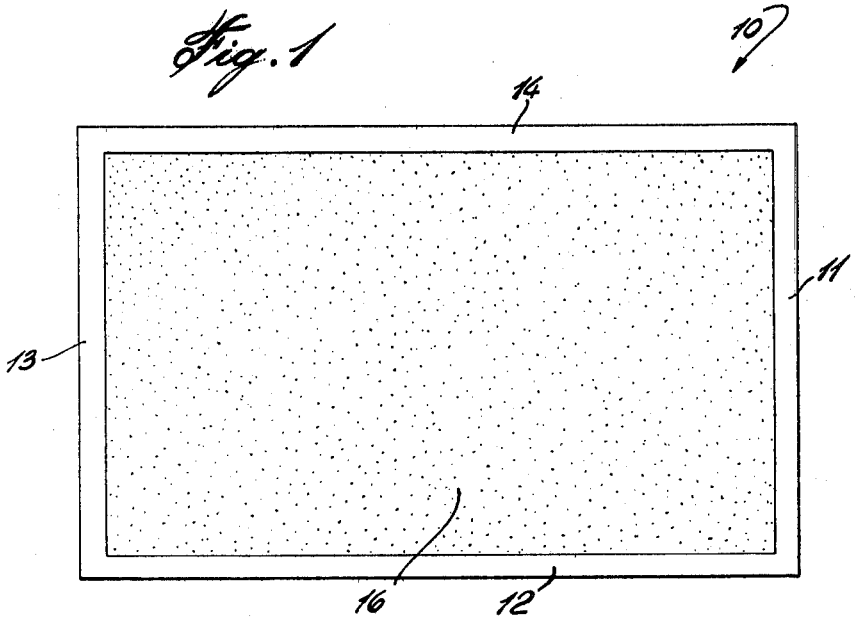
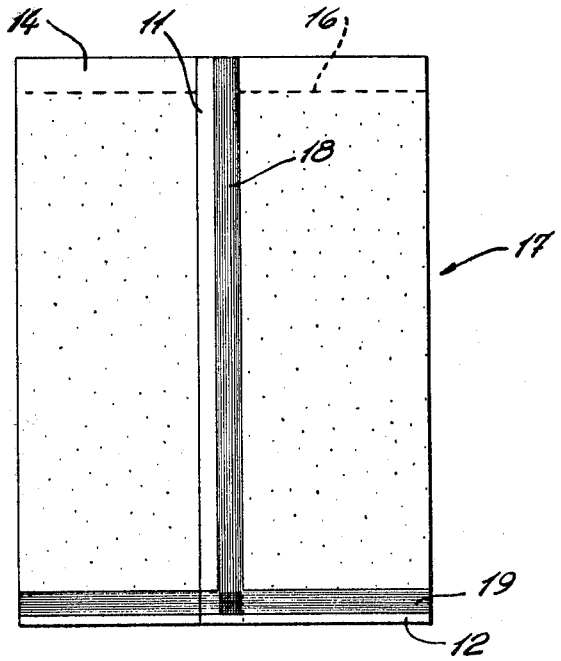
Fig. 2

METHOD OF MAKING POLYETHYLENE SHIPPING SACK WITH FLEXOGRAPHICALLY APPLIED BARRIER COATING

This invention relates to polyethylene shipping sacks having an interior barrier coating and to a method for making such sacks.

Polyethylene shipping sacks are suitable for packaging, transportation and storage of a wide variety of products. However, there are some products such as nitrocarbonitrate, for instance, which cannot be properly packaged in polyethylene sacks because they contain organic constituents which readily permeate the polyethylene with resultant deterioration of packaged product quality, environmental contamination and stacking instability from slippery contaminated outer surfaces of the sacks. Thus when one is faced with the problem of packaging the above kind of products, he must resort to other packaging materials.

Plastic films made of, for instance, polyvinylidene chloride, nylon and nitriles have the appropriate barrier qualities required for these applications. However, because of high cost and difficulty in conversion to sacks, they are not used by themselves for industrial shipping sacks. Because of their incompatibility with low density polyethylene (LDPE) films, these barrier films cannot be heat sealed between the layers of a polyethylene film to give an acceptable seal for shipping sacks. The use of these materials has therefore been limited to a role as expensive liners in shipping sacks contributing no seal strength to the finished bag, acting purely as a barrier layer. These limitations have up to now drastically reduced the utility of plastic bags for packaging the above mentioned type of products.

It is thus an object of this invention to provide a polyethylene film bag and a process for making same, having an internal barrier coating which makes it suitable for packaging materials that readily migrate or permeate through polyethylene. This and other objects and advantages of the invention will become further apparent from the following description.

In accordance with the invention, a process for the production of bags, sacks and like containers having an internal barrier coating comprises:

(a) treating one surface of a length of polyethylene film adapted to be folded and heat sealed to make it receptive to printing inks;

(b) to the treated surface of the film except portions which are to be heat sealed, flexographically applying a layer of a lacquer comprising a solution of a nylon resin in at least one alcohol selected from C1 to C5 aliphatic alcohols and mixtures of at least one of said alcohols with up to 15% by weight water;

(c) drying the applied lacquer and folding opposite sides of the length of new nylon coated polyethylene film inwardly of the nylon coating until the edge portions overlap one another;

(d) heating sealing the overlapping portions together along the length of the overlapping region, and (e) heat sealing one of the two open ends transversely of the folded film, the other end being adapted to be heat sealed by being left open.

The invention also provides a bag, sack or like container comprising a length of polyethylene film having its sides folded inwardly so that its edge portions overlap one another, a heat seal uniting the overlapping portions along the length of the overlapping region and a transverse heat seal along one end of the folded film, the other end being left unsealed but being heat sealable, said length of polyethylene film being characterized in that the surface thereof forming the interior of the bag is receptive to printing inks and carries a flexographically applied dry layer not more than 0.0003 inch thick of a nylon resin which is soluble in C1 to C5 aliphatic alcohols and up to 15% water by weight.

By polyethylene film as used hereinabove, it is meant film of suitable thickness and strength for shipping bags and made of low density polyethylene as well as linear low density polyethylene.

Treatment of a surface of the polyethylene film to make it receptive to the nylon lacquer which will later be applied thereto, may be made by any of several different techniques very well known to those versed in the art such as chlorination, chemical oxidation (acid etching), flame in the presence of air, or by inducing a high energy electrical discharge near the film surface, again in the presence of air. Particularly preferred among these techniques is the electrical discharge (corona discharge) because of its effectiveness, comparative simplicity and flexibility of operation.

Once the film has been treated as above, its treated surface except portions thereof which are to be heat sealed is coated with a barrier layer of nylon. The latter is applied by flexography from a lacquer which is a solution of the nylon in one or more of the C1 to C5 aliphatic alcohols. Preferably the alcohol solvent will contain up to 15% water by weight.

Nylon is a generic name for polyamides which are synthetic condensation products containing recurring aliphatic and/or aromatic amide groups as integral parts of the main polymer chain. Nylons which are suitable for use in the invention are those, as implied above which are soluble in C1 to C5 aliphatic alcohols and mixture thereof. Particularly preferred is a nylon resin sold by E. I. Du Pont de Nemours under the trade mark "Elvamide" 8063 which is a terpolymer of nylon 6, nylon 66 and nylon 610.

Preferred among the alcohols are methanol and propanol. Whereas these alcohols may be used above, they can be mixed together as well as with other alcohols of the above C1 to C5 group. Where water is added to the alcohols it will be in an amount of up to 15% by weight, the optimum amounts, for instance, with methanol and propanol being about 15% and 10% respectively.

The concentration of nylon in the solution should be such that the flexographic application thereof to the treated surface of the polyethylene film will result in a continuous nylon coating having a thickness, when dry, not exceeding 0.0003 inch. To attain such a result it has been found that the nylon solution should contain from 1% to 20% by weight of nylon preferably about 10%.

According to the invention, the nylon lacquer is applied to the treated surface of the length of polyethylene film except portions thereof which are to be heat sealed by the flexographic process which is well known to those skilled in the art since it is widely used for the printing of polyethylene film. Once the lacquer coating has been applied to the film, it is dried by any suitable technique.

Preferred drying techniques are, of course, those which allow the fastest speed possible where the process of the present invention constitutes a stage in a process for making bags from a continuous length of polyethylene film.

One form of bag made by the process of the invention is illustrated in the accompanying drawing in which:

FIG. 1 shows a length of film adapted to be folded and heat sealed to make a bag and FIG. 2 is an elevational view of a bag made from the coated film of FIG. 1.

FIG. 1 thus represents a length 10 of polyethylene film of rectangular configuration, the facing surface of which has been treated to make it receptive to printing inks. Except for a narrow margin represented by reference numerals 11, 12, 13 and 14 around the periphery of the length of film, the treated facing surface carries a continuous nylon resin coating 16 of thickness not exceeding 0.0003 inch.

In FIG. 2, there is shown generally at 17 a bag formed from the coated film of FIG. 1 by folding it inwardly of the nylon coated surface until the uncoated margins 11 and 13 overlap one another. Margin 13 does not appear in FIG. 2 because it lies under margin 11. The overlapping margins 11 and 13 are seamed together by a heat seal 18 running to and through bottom end margin 12 and top end margin 14 both said margins being also uncoated. A transverse heat seal 19 runs across the whole width of the bag along margin 12 to form the bottom of the bag. The top end of the bag is not sealed but is heat sealable by virtue of the top margin 14 being uncoated.

Many modifications may be made to the abovedescribed embodiment of bag without departing from the spirit and scope of the invention. For instance, the bag may be closed at the top by means of a transverse heat seal running along the uncoated top margin 14. In such an embodiment, however, the heat seal 18 uniting overlapping margins 11 and 13 will stop at a distance from the top transverse heat seal whereby to leave between said overlapping margins 11 and 13 a tubular opening through which the bag may be filled by means of a filling spout.

This modified embodiment of the bag of the invention may be further modified by providing it with an outer ply of uncoated polyethylene film. In this further modified embodiment, heat seal 18 uniting overlapping margins 11 and 13 is preferably replaced by a U-shaped heat seal of which the curved end lies at a distance from the top heat seal and the two branches extend to the bottom heat seal. More preferably, in the overlapping region, the overlapping portion of the outer ply, which projects inside the bag will be narrower than the corresponding overlapping portion of inner ply. With this construction there result a bag, a bag having a self-closing filling valve between the top heat seal and the bottom of the inverted U-shaped heat seal such bag still being characterized in that its inner ply has an internal barrier coating of nylon.

The invention will be further illustrated by the following example but its scope is not limited thereby.

EXAMPLE

A 6 mil polyethylene film was corona discharged treated to 40 dynes on one of its surfaces. The treated surface was thereafter flexographically coated with a nylon ("Elvamide") lacquer using 100% methanol solvent to produce a dry nylon barrier layer 0.0001 inch thick. While the uncoated film showed a permeation value to No. 2 fuel oil of 13 gm/sq. meter/24 hrs, the coated film showed a permeation rate of only 1.2 gm/sq. meter/24 hrs. When a similar nylon coating was applied using an 85/15 w/w methanol/water solvent, the permeability rate dropped to 0.10 gm/sq. meter/24 hrs.

We claim:

1. A process for making bags, sacks and like containers having an internal barrier coating comprising:

(a) treating one surface of a length of polyethylene film adapted to be folded and heat sealed to make a bag, so as to make said surface receptive to printing inks;

(b) to the treated surface except portions thereof which are to be heat sealed, flexographically applying a layer of a lacquer comprising a solution of a nylon resin in at least one alcohol selected from the C1–C5 aliphatic alcohols and mixtures of at least one of said alcohols with up to 15% by weight of water;

(c) drying the applied lacquer and folding opposite sides of the length of now coated polyethylene film inwardly of the nylon coating until the edge portions overlap one another;

(d) heat sealing the overlapping portions together along the length of the overlapping region; and (e) heat sealing one of the two open ends transversely of the folded length of film, the other end being left open but being heat sealable.

2. A process as claimed in claim 1 wherein the polyethylene is low density polyethylene or linear low density polyethylene.

3. A process as claimed in claim 2 wherein step (a) the surface of the film is treated by corona discharge.

4. A process as claimed in claim 3 wherein the nylon solution contains from 1% to 20% by weight of nylon.

5. A process as claimed in claim 4 wherein the nylon is a terpolymer of nylon 6, nylon 66 and nylon 610.

6. A process as claimed in claim 5 wherein the alcohol is selected from methanol and propanol.

7. A process as claimed in claim 6 wherein the alcohol is methanol and is in admixture with about 15% by weight of water.

8. A process as claimed in claim 6 wherein the alcohol is propanol and is in admixture about 10% by weight of water.

* * * * *